United States Patent [19]

Osmera et al.

[11] 4,203,675

[45] May 20, 1980

[54] PRESSURE PRINTER

[75] Inventors: Miroslav Osmera, Waterloo; Rudolf Enter, Kitchener; Robert McCallum, Erin, all of Canada

[73] Assignee: NCR Canada Ltd. - NCR Canada Ltee, Mississauga, Canada

[21] Appl. No.: 937,350

[22] Filed: Aug. 28, 1978

[51] Int. Cl.[2] ..... B41J 1/30

[52] U.S. Cl. ..... 400/144.2; 101/93.18; 101/93.47

[58] Field of Search ..... 400/144–144.4, 400/128–134.6, 23–27; 101/93.18, 93.47

[56] References Cited

U.S. PATENT DOCUMENTS

| | | | |
|---|---|---|---|
| 2,911,086 | 11/1959 | Martindell | 400/130 |
| 2,927,676 | 3/1960 | Abbondanza | 400/130 X |
| 3,625,330 | 12/1971 | Marinoff | 400/134 |
| 3,768,619 | 10/1973 | Lewis | 400/131 X |
| 3,861,299 | 1/1975 | Drillick | 400/130 X |

*Primary Examiner*—E. H. Eickholt

*Attorney, Agent, or Firm*—J. T. Cavender; Wilbert Hawk, Jr.; George J. Muckenthaler

[57] ABSTRACT

A document or other record media along with an associated inked ribbon and a type character are pressed together at the same time from two sides by means of two pressing members pivoted on a common shaft. The pressing members are connected with a toggle linkage which is caused to be actuated from a home position to a printing position and return. The actuation of the linkage moves a platen and a hammer towards each other to perform the printing on the document.

5 Claims, 9 Drawing Figures

PRESSURE PRINTER

BACKGROUND OF THE INVENTION

In printing mechanism, the print hammer usually is caused to be moved against the record media, in turn against the platen which platen is normally fixed or secured in a precise position to provide a printing line. Alternatively, the hammer may be fixed or secured and the platen may be movable or pivotable to press against the hammer or type wheel or a like type character carrying member.

Representative prior art in the area of movable hammer means or movable platen means is as follows:

U.S. Pat. No. 3,333,670, issued to Z. A. Yazejian et al. on Aug. 1, 1967, discloses a step by step incremental feed mechanism utilizing a linkage train formed of three links connected in a pivotable manner and disposed to be actuated by an actuator.

U.S. Pat. No. 3,693,473, issued to R. W. Beachner on Sept. 26, 1972, discloses a controlled pressure platen wherein the platen is movable through a pair of actuating toggle linkages.

U.S. Pat. No. 3,693,543, issued to H. F. Noller on Sept. 26, 1972, shows imprinting mechanism wherein the die plate is fixed and the platen is movable with a wedge being utilized to vary the platen pressure.

U.S. Pat. No. 3,758,010, issued to P. H. Hamisch on Sept. 11, 1973, discloses printing apparatus wherein a print head assembly is secured to the frame and the platen assembly is pivotally mounted to the frame.

U.S. Pat. No. 3,768,619, issued to R. A. Lewis on Oct. 30, 1973, shows a printing machine wherein certain elements are stacked together and commonly compressed between a linearly closing anvil and piston and wherein a control system regulates the force of the thrust during the printing process with one of a series of flat platens of different thicknesses being selectively used between the anvil and piston.

U.S. Pat. No. 3,804,015, issued to R. H. Colwill on Apr. 16, 1974, discloses a toggle platen unit wherein the platen is rockable on an arcuate work surface.

U.S. Pat. No. 3,842,957, issued to W. G. Wilkin et al. on Oct. 22, 1974, shows a selective marking apparatus including a drive shaft for raising and lowering a piston and wherein the drive shaft actuates the piston in a reciprocating manner and after actuating the piston, the shaft reciprocates independently of the piston.

U.S. Pat. No. 3,878,779, issued to J. G. Clary on Apr. 22, 1975, discloses a squeeze printer having a fixed platen and a combined aligning and movable printing bar.

And, U.S. Pat. No. 3,967,550, issued to R. E. Busch on July 6, 1976, shows a squeeze printer having a fixed type wheel and a movable platen.

SUMMARY OF THE INVENTION

The present invention relates to printing or encoding apparatus and more particularly to a printing module for printing MICR (magnetic ink character recognition) or OCR (optical character recognition) printing. A document, an ink ribbon and a type character are pressed together from both sides in the center plane of a document track by two compressing members which are pivoted on a common shaft and simultaneously moved toward the document. The front pressing member or hammer is forked on the common shaft to provide space for the rear pressing member, an anvil or platen, which also moves upon actuation of the members toward the document. Each of the arms for the pressing members opposing the tips of the pressing members is connected by a separate pin, with one of two identical toggle levers which are interconnected by a common pin together with a rocking arm which allows the common pin to move in an arc about a shaft which is held in the frame of the machine. The common pin is linked to a connecting rod and to a crank mounted on the shaft of a drive motor wherein, as the motor shaft turns, the crank pin follows a circular motion and generates movement of the connecting rod, the common pin, the rocking arm, the toggle levers and the pressing members, which members include the hammer and the platen.

In view of the above discussion, the principal object of the present invention is to provide a printing module with improved print quality.

Another object of the present invention is to provide a printing module which operates at a lower noise level.

An additional object of the present invention is to provide a printing module wherein both the hammer member and the platen member are moved or rocked toward each other in simultaneous motion to provide imprinting on the document.

A further object of the present invention is to provide a printing module with a low noise level and low velocity force contact while transferring ink from a ribbon to the paper document.

Additional advantages and features of the present invention will become apparent and fully understood from a reading of the following description taken together with the annexed drawing.

DESCRIPTION OF THE PREFERRED EMBODIMENT

Figure 1:
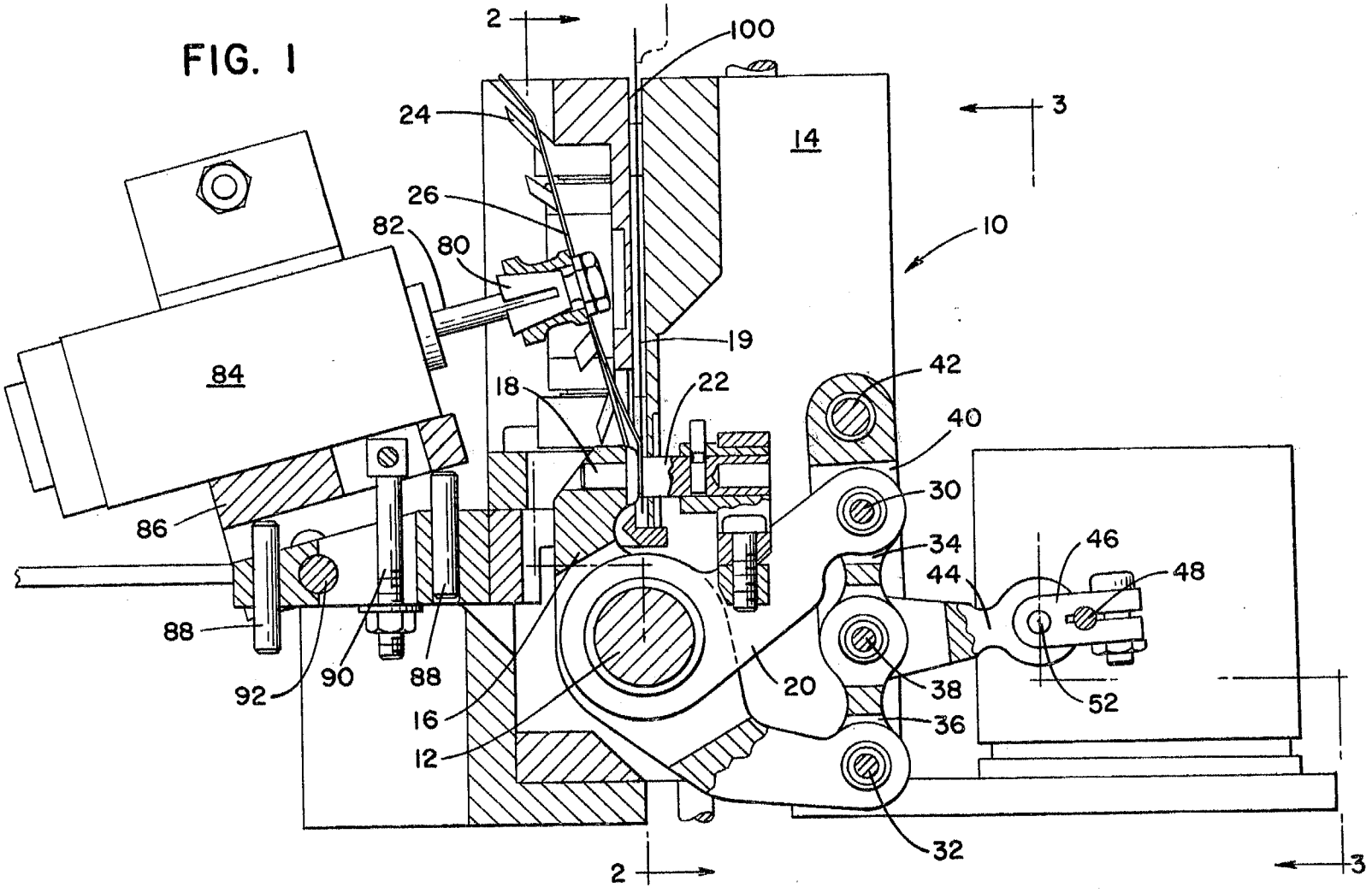
FIG. 1 is a side elevational view, partially in section, showing the arrangement of the several parts of the printing module.
Figure 2:
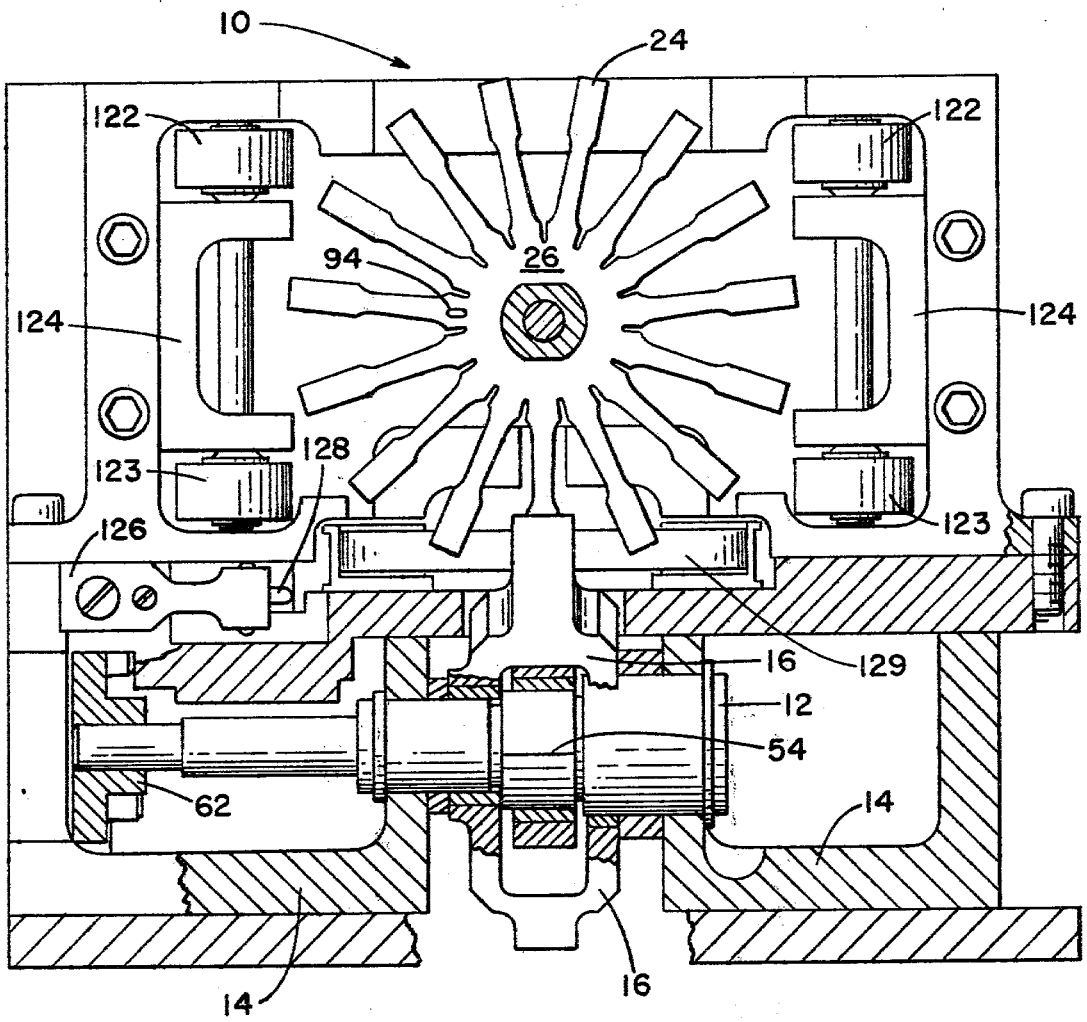
FIG. 2 is a front elevational view, partially in section, and taken along the line 2—2 of FIG. 1.

Referring now to FIGS. 1 and 2 of the drawing, a document, an ink ribbon and a type character are caused to be pressed or squeezed together from both sides to perform printing on the document as the document is moved past a printing station. The printer of the present invention includes a number of subassemblies such as a printing mechanism, a type wheel assembly, a document transport mechanism, frame members of the machine, a ribbon drive mechanism and electronic controls.

The pressing members of the printer 10 are shaped as double arm levers pivoted on a common shaft 12 and journaled in a framework 14 of the machine, such framework forming a supporting structure on the several sides of the printer. A front movable or pressing member 16 is carried by the shaft 12 and the tip 18 of the member 16 serves as the hammer for pressing against the document or record medium 19. The member 16 is of forked construction on the shaft 12 (FIG. 2) to provide space for a rear movable or pressing member 20 which is also carried on the shaft 12 and the tip 22 of the rear pressing member serves as the anvil or platen to take the pressure of the hammer against the document 19 and the type character or like marking means carried at the ends of the fingers 24 of a daisy-shaped type wheel 26. Each of the pressing members, front 16 and rear 20, has a rearwardly extending arm which in effect opposes the tip portions or the hammer 18 and the platen 22 of the pressing members 16 and 20. An upper dowel pin 30 and a lower dowel pin 32 connect, respectively, an upper toggle lever 34 and a lower toggle lever 36 to a common center pin 38 together with a rocking arm 40 which is connected to an upper shaft 42 carried by the frame 14 of the printer, the shaft 42 operating as the center of swing of the pin 38, which pin moves in an arc about the upper shaft 42. The center pin 38 is also linked through a connecting rod 44 to a crank 46 mounted on a shaft 48 of a drive motor 50, FIG. 3. Rotation of the shaft 48 causes a crank pin 52 to follow a circular motion and thereby generates movement of all other connected members which include the connecting rod 44, the common center pin 38, the rocking arm 40, the toggle levers 34 and 36 and also the pressing members 16 and 20, along with the associated hammer tip 18 and the platen tip 22.

The shaft 48 of the drive motor 50 rests in the home position wherein the crank pin 52 occupies a position to the right of the shaft 48, as seen in FIG. 1 or on the side of the motor shaft distal from the common shaft 12 and the center pin 38. The motor shaft rotates counterclockwise as seen in FIG. 1 for a one-half turn to go from the home position to the printing position wherein the crank pin 52 occupies a position to the left of the shaft 48 or on the side of the motor shaft near the common shaft 12 and the center pin 38 with the toggle levers 34 and 36 being directed and maintained in a co-linear position. In the printing position, the tips 18 and 22 of the pressing members 16 and 20 are in the closed position and thereby pressing together the document, the ink medium or ribbon, and the type character on the wheel 26 to generate ink transfer from the ribbon onto the document. In the home position, the tips of both pressing members are fully open to provide sufficient clearance for incremental movement of the document 19 and the ribbon and for re-positioning of the type character wheel 26.

In the printing position, the theoretical displacements of the tips of both pressing members 16 and 20 must extend partly over each other to provide adequate pressure and adjustment of the overlapped displacement and consequently, the amount of such pressure is obtained by means of the common shaft 12 being provided and formed with an eccentric portion 54 on which the rear pressing member 20 is pivoted. The starting adjustment position of the common shaft 12 is with the eccentric portion 54 directed downwardly and by turning the common shaft 12 with the eccentric portion 54 rearward towards the drive motor 50, the rear pressing member 20 with its tip or platen 22 is displaced rearward and thereby releases the pressure between the printing tips. By turning the common shaft 12 eccentric portion 54 forward, the tip overlap as well as the pressure between the tips is increased.

Figure 4:
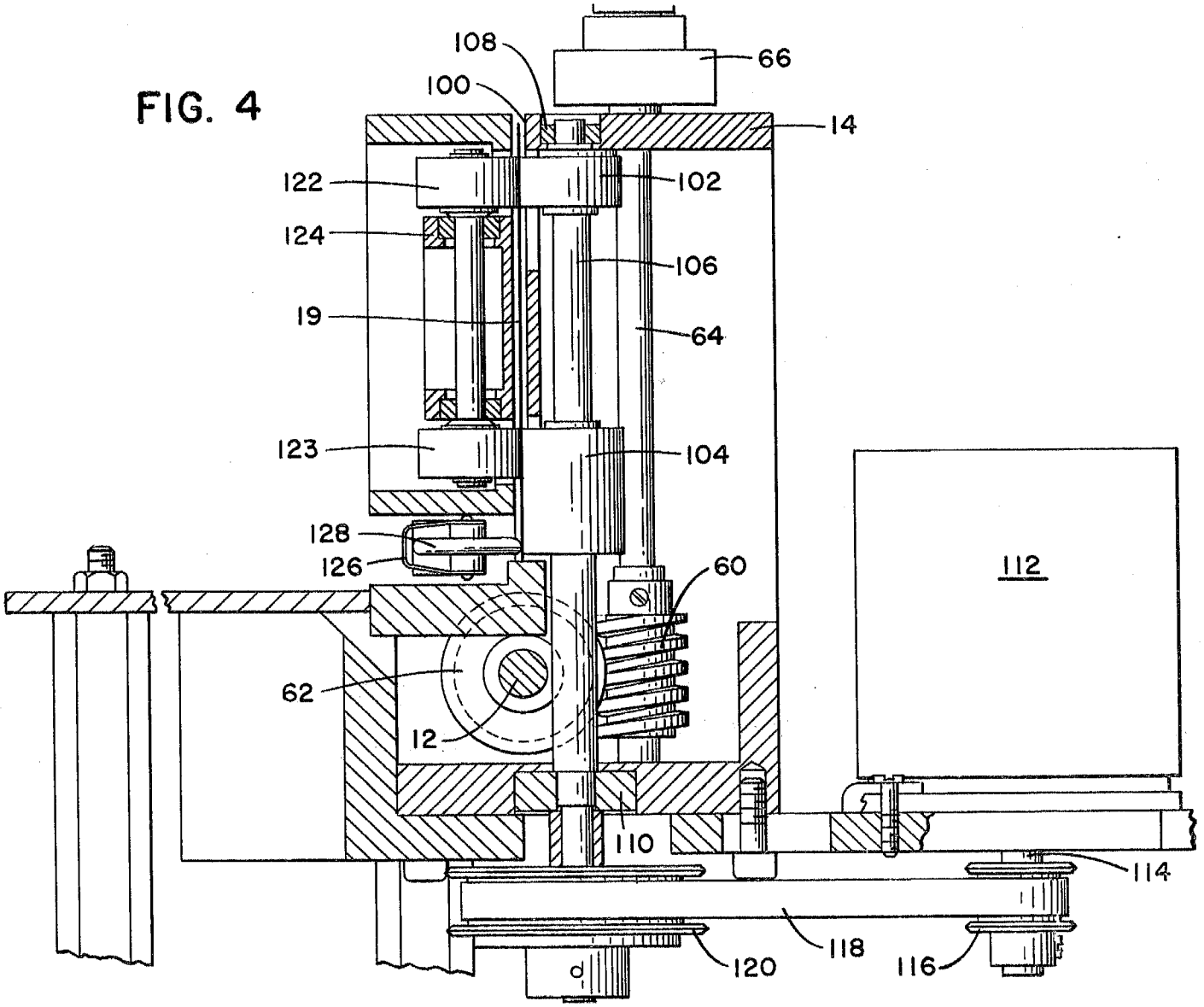
FIG. 4 is a side elevational view showing the transport mechanism for the document.

A worm gear 60 (FIG. 4) is employed to enable the fine tuning of the common shaft 12 in regard to the desired pressure between the tips 18 and 22. A gear wheel 62 (FIGS. 2 and 4) is mounted on the end of the common shaft 12 and engages with the worm gear 60, which is fixed on an adjusting shaft 64 with a knob 66 placed above the frame 14 of the printer. A worm gear ratio of 1:60 is obtained so that one turn of the knob 66 rotates the common shaft 12 a distance of 6 degrees and generates a theoretical platen displacement of 1/10 millimeter. This relationship is applicable within the region of plus or minus 12 degrees of rotation of the common shaft 12.

Figure 3:
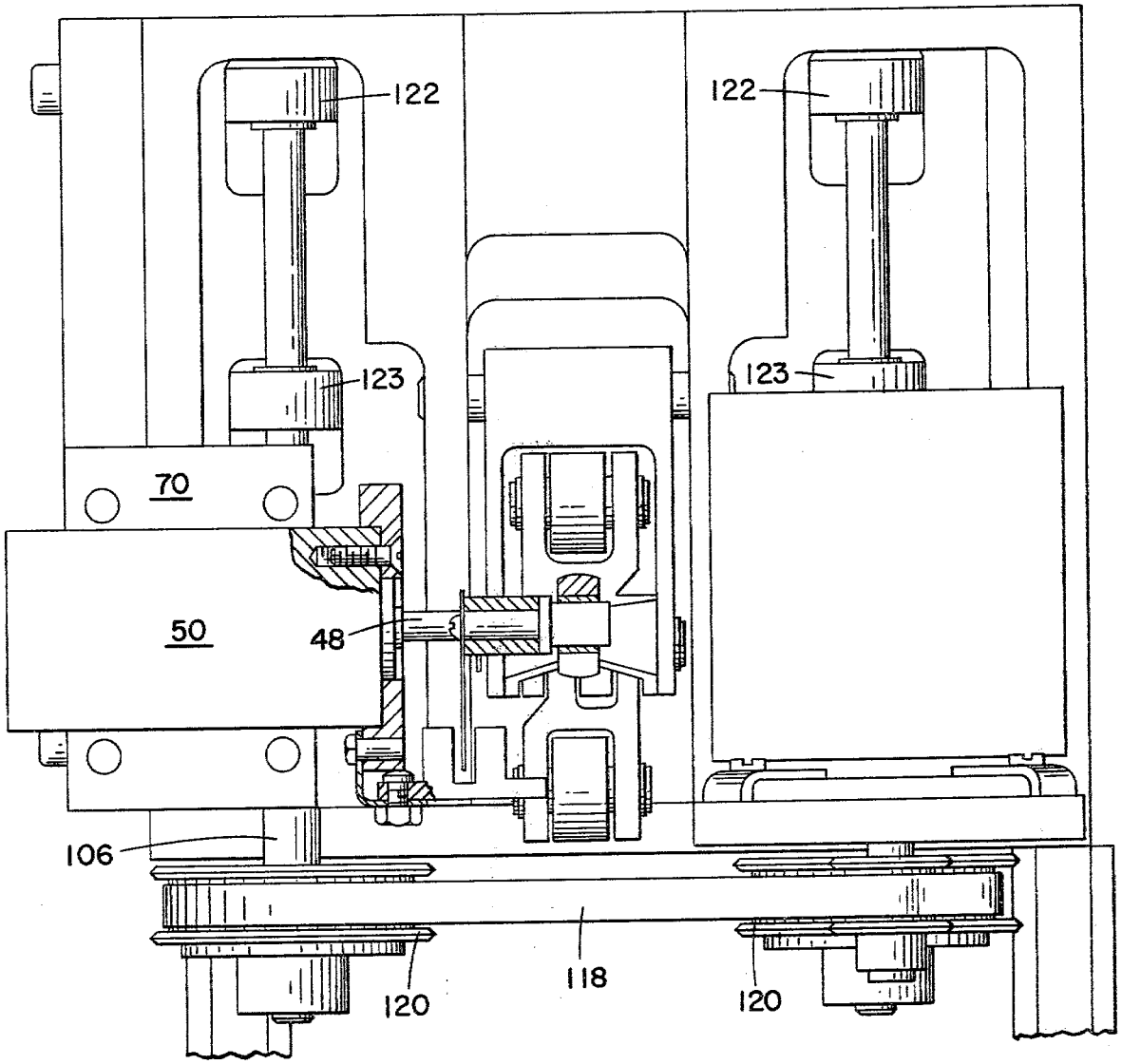
FIG. 3 is a rear elevational view showing drive mechanism and taken along the line 3—3 of FIG. 1.

A second adjustment is for the purpose of eliminating production allowances wherein the drive motor 50 for the pressing members 16 and 20, by means of a holding bracket 70, can be shifted forward or backward, as seen in FIG. 3, after releasing the fastening screw to increase or decrease the distance from the common shaft 12. The motor shaft 48 remains parallel with the common shaft 12 during adjustment to insure that both toggle levers 34 and 36 are maintained in a co-linear condition when the mechanism is going through a printing operation.

The type wheel assembly has the purpose of holding the type wheel 26 stationery and in an exact position during the printing operation, and of repositioning the character finger for subsequent printing. The type wheel 26 (FIG. 1) is mounted by means of a chuck 80 on the shaft 82 of a motor 84 and a motor mounting bracket 86 has provision for vertical position adjustment of the motor with the type wheel 26 through means of set screws 88 and a tension screw 90. The motor mounting bracket 86 is rotatable about a shaft 92 from a printing position to an upright or non-printing position for easy access to the type wheel 26 and for replacement of the ribbon. The various type characters on the fingers of the type wheel 26 are moved into position at the printing station by rotation of the motor shaft 82 by the motor 84. Motion feedback of the type wheel 26 is obtained from position sensors (not shown) by means of evenly-spaced position holes and a single index hole 94 (FIG. 2) formed as a part of the type wheel 26.

The document transport mechanism includes a slot or track 100 (FIGS. 1 and 4) formed by a pair of spaced upper drive rollers 102 (FIG. 4) and a pair of spaced lower drive rollers 104 fastened on shafts 106 journaled in upper bearings 108 and lower bearings 110. A drive motor 112 having a shaft 114 and a pulley 116 drives a timing belt 118 (FIGS. 3 and 4) which is trained around a driven pulley 120 on each of the shafts 106. A pair of upper idler rollers 122 and a pair of lower idler rollers 123 are mounted in respective brackets 124 (FIGS. 2 and 4) to cooperate with the drive rollers 102 and 104. The idler brackets 124 form the front wall of the track 100 and are adjustable to provide the required tension between the drive rollers 102, 104 and the idler rollers 122, 123. Provision is also made for variations in the thickness of documents by using a sensing arm 126 (FIGS. 2 and 4) with a follower 128 in engagement with one of the lower drive rollers 104 wherein upon insertion of a document between the follower 128 and the drive roller 104 the sensing arm 126 is lifted and a sensor (not shown) activates an adjustment of the shaft 64.

The framework 14 is designed to provide a compact arrangement of the various parts and to enable parallelism between the common shaft 12, the drive motor 50 and the upper shaft 42 and to sustain the forces originating in the pressing members 16 and 18. The ribbon drive for the printer makes use of a magnetic ink ribbon 129 which is released from a lower bobbin (not shown) and then threaded through a ribbon guide in front of the type wheel 26, the ribbon being pulled by a clutch-type roller which is operated by a gear motor and then rewound on an upper bobbin.

Figure 5:
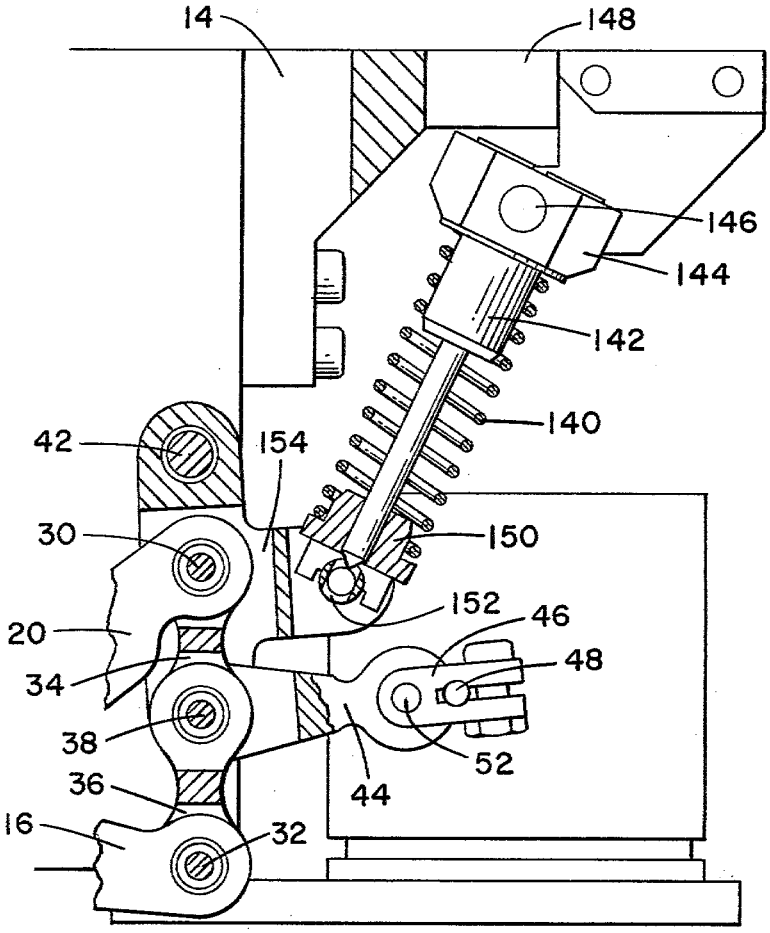
FIG. 5 is an elevational view showing a modification in the arrangement of the several elements.

FIG. 5 shows a modification of the arrangement of the several parts for the purpose of storing kinetic energy of the moving linkage during the printing cycle wherein a compression spring 140 is supported by a force adjusting bolt 142 threaded in a nut 144 which is pivoted on a pin 146 carried in a bracket 148 secured to the frame 14. The other end of the spring 140 is seated on a member 150 supported by a hollow pin 152 carried by a rocking arm 154 which is connected to the upper shaft 42. As soon as the crank 46 starts its movement from the home position toward the printing position, the force component of the compressed spring 140 becomes greater and adds acceleration to the movement. On the return stroke from the printing position to the home position, the spring 140 is compressed and the energy of the moving parts is stored in the spring to help decelerate and stop the crank 46 at the home position.

Figure 6:
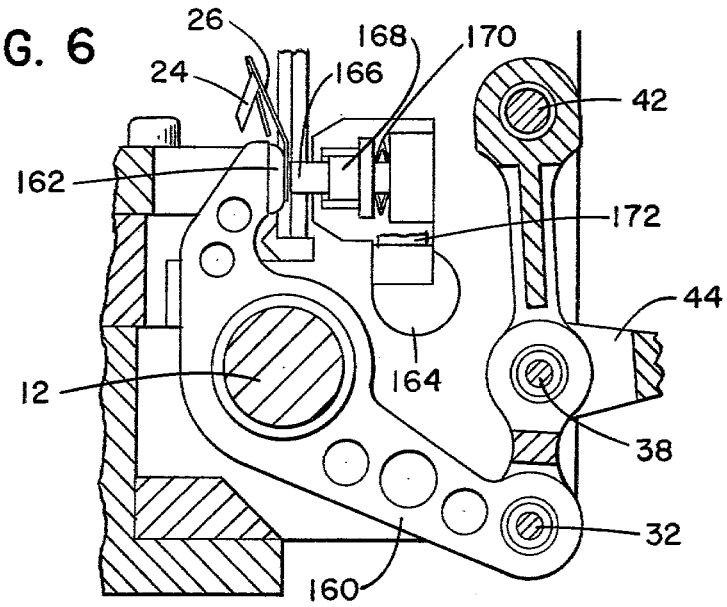
FIG. 6 is a side elevational view showing a further modification of the arrangement of the several elements for the invention.

FIG. 6 shows a second modification wherein the front pressing member 16 is replaced with a similar member 160 which is carried by the shaft 12 and by the pin 32 and includes a hammer 162 positioned to engage with fingers 24 of the type wheel 26. The movable back pressing member 20 is replaced with a pressing member 164 which is supported from the frame 14 and arranged to carry an anvil or platen 166 which is resiliently structured by means of a plunger 168 backed by steel spring washers 170 and mounted in a bracket 172 connected with the pressing member 164.

The operation of the pressure printer requires electronic control for the hammer mechanism, the document transport mechanism, the type wheel positioning system and the ribbon advance drive. These various mechanisms are coordinated by an overall controller which also performs the functions of data communication, buffering and formatting.

The hammer mechanism is driven by a permanent magnet ironless rotor DC servo motor which is powered by a high current operational amplifier. The external feedback signals for the control circuit originate from a pair of photo interruptor cells which sense the crank position by means of a vane attached to the crank and wherein a logic pulse initiates a single hammer cycle which results in one complete rotation of the crank.

Figure 9:
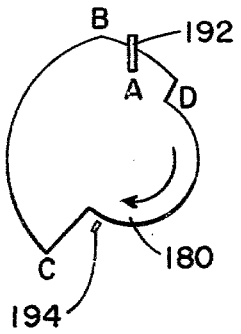
FIG. 9 is a detail of the feedback disc utilized in the sensing arrangement.
Figure 7:
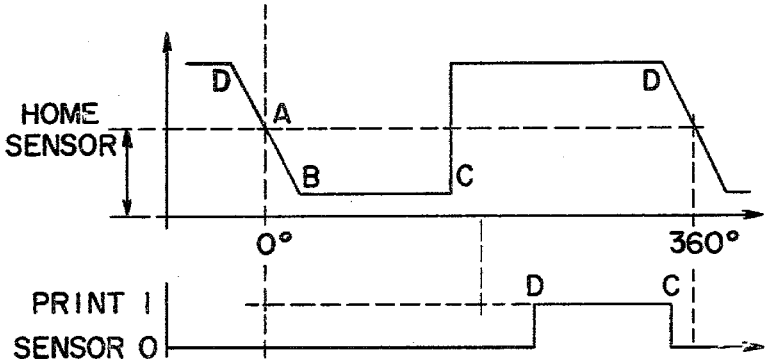
FIG. 7 is a timing diagram of the operation of the home sensor and the print sensor.

As seen in FIG. 7, the outputs of two feedback sensors use the home position as a 0 degree reference and the linear ramp between B and D of a vane 180 (FIGS. 8 and 9) provides an angle signal at the home sensor whereby the crank 46 can be positioned and held at the home position, it being seen that the print sensor detects only the presence or absence of the vane.

Figure 8:
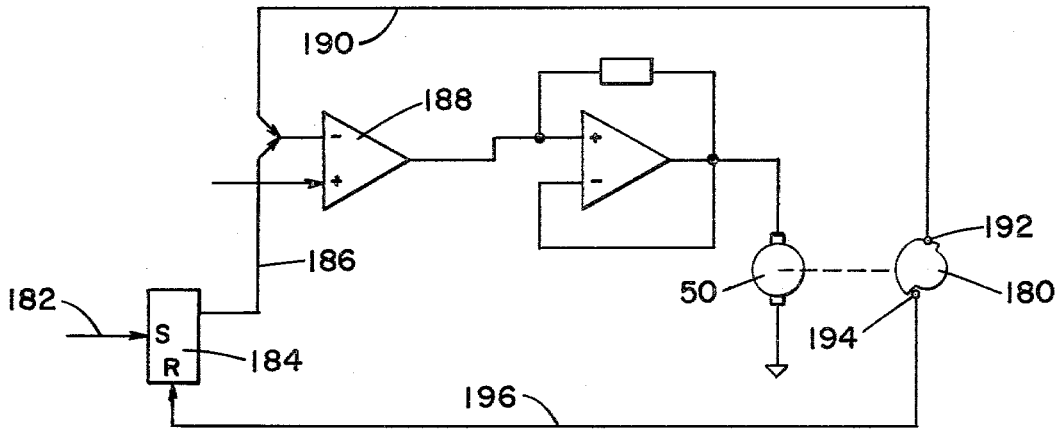
FIG. 8 is a circuit diagram of the home sensor and the print sensor of the present invention.

Referring to FIG. 8, it can be seen that with the leading edge of a start pulse 182, a flip flop 184 is set to thereby generate a positive velocity input signal 186 to an error amplifier 188. This signal is greater than the negative signal 190 which develops from the home sensor 192 as the crank 46 starts to rotate, thereby causing the velocity input to remain positive. A peak speed of about 4,000 rpm is reached by the time the printing angle is ascertained, and this speed is required both for achieving the proper printing rate and to build up kinetic energy to pass through the mechanism's high friction arc during printing operations.

After the crank 46 has passed through the print position, the print sensor 194 detects the leading edge D of the vane 180 and sends a signal 196 to cause the flip flop 184 to be reset. This leaves only the output 190 of the home sensor as a velocity input which is now a positive signal, but at a lower level than during the first part of the rotation which was generated by the flip flop 184. The home sensor output 190 starts to decrease when edge D passes by, thereby causing a corresponding reduction of the velocity input signal.

The output of the home sensor continues to decrease until position A is reached and a 0 value of the output is recorded. The crank speed will also be at 0 at position A. If position A passes the home position by reason of overshoot, the velocity input commences to go negative which causes a motor reversal until position A is again reached with the vane portion from A to C being provided for an overshoot condition.

It is thus seen that herein shown and described is a pressure or squeeze type printer that utilizes a moving hammer and a moving platen in a rocking motion to enable printing on a document therebetween and at a reduced noise level so as to provide for acceptability in different areas of an environment. The mechanism enables the accomplishment of the objects and advantages mentioned above and while a preferred embodiment of the invention has been disclosed herein, variations and modifications thereof may occur to those skilled in the art, in addition to the modifications shown and described. It is contemplated that all such variations and modifications not departing from the spirit and scope of the invention hereof are to be construed in accordance with the following claims.

What is claimed is:

1. Means for transferring ink from an ink medium onto a record medium comprising a:

character bearing member, a first swingably movable member, a second swingably movable member, said ink medium and said record medium being positioned between said first member and said second member, a common pivot member for supporting said first movable member and said second movable member, and means including a pivot member and toggle members carried therefrom to allow swinging movement of said toggle members from said pivot member and connected for simultaneously moving said first member and said second member toward each other and into engagement with said ink medium and said record medium upon contact with said character bearing member.

2. The subject matter of claim 1 wherein said first movable member comprises a hammer and said second movable member comprises an anvil positioned to be pressed against said ink medium and said record medium.

3. A printing mechanism for printing on a record medium comprising a:

rotatable type character carrying member adjacent said record medium, a first member swingably movable against one side of said type character carrying member, a second member swingably movable against the record medium, a common pivot member for supporting said first member and said second member, means including a pivot member and toggle members carried in swinging movement therefrom, and drive means connected with said toggle members for causing said first member and said second member to be simultaneously moved toward each other and against said record medium and said type character carrying member.

4. The printing mechanism of claim 3 wherein said causing means includes a crank member and said drive means is connected with said crank member.

5. In a printer having a type character bearing member and a record paper adjacent said member for printing thereon, a first member positioned to be swingably moved against said type character bearing member, a second member positioned to be swingably moved against said record paper, means supporting said first member and said second member along a common axis, pivot means carried by said printer, toggle means connected with said supporting means for causing movement thereof, and drive means connected with said toggle means for swinging thereof about said pivot means and for rocking said supporting means to simultaneously move said first member and said second member toward each other and against the type character bearing member and the record paper.

* * * * *